United States Patent [19]

Chandler

[11] 4,115,670

[45] Sep. 19, 1978

[54] ELECTRICAL SWITCH ASSEMBLY

[75] Inventor: Roy L. Chandler, Arlington, Tex.

[73] Assignee: Geno Corporation, Arlington, Tex.

[21] Appl. No.: 791,063

[22] Filed: Apr. 26, 1977

Related U.S. Application Data

[60] Continuation-in-part of Ser. No. 667,040, Mar. 15, 1976, abandoned, which is a division of Ser. No. 325,206, Jan. 19, 1973, Pat. No. 3,944,972.

[51] Int. Cl.[2] ..... H01H 3/00; H01H 15/00

[52] U.S. Cl. ..... 200/5 R; 200/16 R; 200/18; 200/50 C; 200/153 K; 200/330

[58] Field of Search ..... 200/1 R, 5 R, 4, 6 R, 200/7, 16 R, 17 R, 18, 50 C, 153 R, 329, 330, 339, 6 A, 11 K, 16 C, 16 D, 153 K, 295, 303; 340/74

[56] References Cited

U.S. PATENT DOCUMENTS

| | | | |
|---|---|---|---|
| 2,683,193 | 7/1954 | Barcus | 200/16 C |
| 2,919,315 | 12/1959 | Woofter | 200/16 C |
| 2,960,580 | 11/1960 | Aquillon | 200/50 C X |
| 3,209,088 | 9/1965 | Wanlass et al. | 200/16 C |
| 3,290,454 | 12/1966 | Hubert | 200/5 R |
| 3,470,339 | 9/1969 | Roman | 200/329 X |
| 3,784,765 | 1/1974 | Daly | 200/16 D X |
| 3,944,972 | 3/1976 | Chandler | 340/74 |

FOREIGN PATENT DOCUMENTS

| | | | |
|---|---|---|---|
| 787,469 | 12/1957 | United Kingdom | 200/330 |

*Primary Examiner*—James R. Scott
*Attorney, Agent, or Firm*—Charles W. McHugh

[57] ABSTRACT

An assembly of at least two single-pole, double-throw slide switches, with one of the switches being mounted 90° with respect to the other switch. A movable plate is positioned above the two SPDT switches, and the movable plate has apertures or the like which engage the projecting arms of the two SPDT switches, whereby translating movement of the movable plate causes action of one or both of the SPDT switches. Appropriate springs are provided to bias the movable plate to a centered, rest position at all times. Hence, movement of the movable plate as a result of some manual force may affirmatively generate any one of eight distinct signals. The centered rest position of the movable plate may also be considered as a signal-generation position, such that nine distinct bits of information may be communicated through the manual manipulation of a single knob that is connected to only two SPDT slide switches.

14 Claims, 10 Drawing Figures

ELECTRICAL SWITCH ASSEMBLY

CROSS-REFERENCES TO RELATED APPLICATIONS

This is a continuation-in-part of application Ser. No. 667,040 filed Mar. 15, 1976 (now abandoned), which was a division of application Ser. No. 325,206 filed Jan. 19, 1973, now U.S. Pat. No. 3,944,972.

BACKGROUND OF THE INVENTION

This invention relates generally to electrical switches, and more particularly it relates to a physical arrangement of two SPDT slide switches which—in combination—have a capability that is characteristic of more sophisticated momentary-on switches.

There are many occasions when it is desirable to foster the correct steering of a vehicle by a driver who cannot see where the vehicle is moving with respect to it surroundings. This is especially true when the vehicle is being backed into a parking spot, and the vehicle is so large that it obstructs the driver's view of the area into which the vehicle is backing. In such a case, it is desirable to have a communication device which will permit an observer who is at an advantageous position adjacent the vehicle (such as to the rear thereof) to send signals to the driver of the vehicle, in order to give said driver instructions concerning the way that the vehicle should be steered, etc. For example, the communication device may be used by an observer on foot to send instructions to the driver of a large recreation vehicle (such as a motor home) when the driver cannot see where his vehicle is going. Examples of signals which an observer would likely want to communicate to the driver are: (1) stop, (2) back up, (3) pull forward, (4) turn right, (5) turn left, (6) back up while turning left, (7) back up while turning right, (8) pull forward while turning left, and (9) pull forward while turning right. While it would obviously be possible to permit an observer to communicate with the driver with a pair of radios, such as the popular "Walkie-Talkies" which operate in the Citizens Band range, such radios are relatively expensive—if they are of a quality to provide reliable and interference-free service. Also, at the time that a certain driver needs guidance information for his vehicle, some other party may be broadcasting on the only available channel (e.g., channel 14); so the driver must wait for his turn in order to have a clear channel to communicate with his observer. Accordingly, there has been a need for a reliable—but economical—means for permitting private and readily available communication between an observer and the vehicle driver.

Another difficulty has been that those persons who are adults and should know their right hand from their left have been known sometimes to mistakenly say "right" when they meant left. Also, there are many children who do not have the left-right relationship well settled in their minds, such that they do not know how to issue correct vocal instructions; but even young children are usually capable of seeing whether or not a car is correctly approaching a trailer, and they could give meaningful information to the driver based on spatial relationships—if they only had some way to convey what they see. Hence, it is an object of this invention to provide a switching device which does not rely on spoken language and which should be useful for most any observer to give instructions to the driver of a vehicle as he attempts to move it towards a desired target.

One more object is to provide a momentary-off capability for a basic single-pole, double-throw slide switch.

A further object is to provide a technique for ganging two single-pole, double-throw switches 90° apart so that they will provide a centered rest position for a central arm between four possible positions along two orthogonal axes.

These and other objects and advantages will be apparent from the specification and claims, and from the accompanying drawing illustrative of the invention.

In the drawings

SUMMARY OF THE INVENTION

Briefly, the invention contemplates use of a control box which is adapted to be held by an observer at a position where he can see both the vehicle and its surroundings that are of concern, e.g., trees, parked cars, water faucets and other obstacles. Most commonly the observer will be at the rear of a backing vehicle and facing the vehicle. The control box, which is the means by which signals are generated, will usually be held horizontally in one hand of the observer and oriented the same way the vehicle is oriented. In the preferred embodiment, a single knob 16 projects upwardly from the top of the control box 14 in such a way that it can be touched and moved by a finger or thumb of the observer. Within the control box 14 are two switches, which will referred to in accordance with the guidance function they perform, namely, a movement switch $S_1$ and a steering switch $S_2$. Both the movement switch $S_1$ and the steering switch $S_2$ are preferably low voltage, single-pole, double-throw (SPDT) slide switches. Such switches are very economical to manufacture because of their simple design, and they are generally quite reliable. According to this invention, they can be installed in an assembly which will additionally provide momentary-on action. Of course, a momentary-on feature, per se, is not new; but it is a feature which normally is available only in switches costing at least three times as much as basic SPDT slide switches.

DESCRIPTION OF THE PREFERRED EMBODIMENTS

Figure 1:
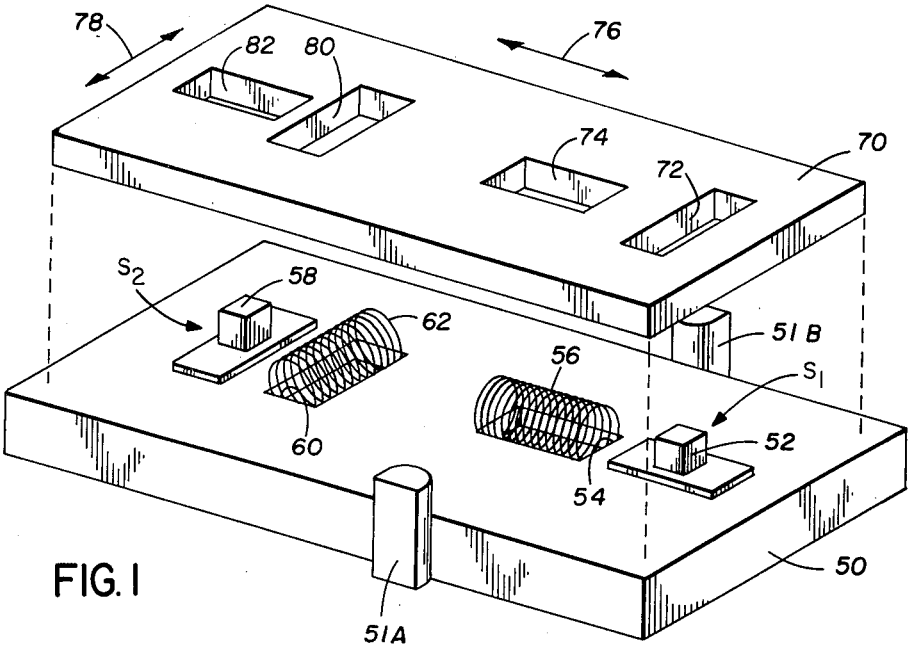
FIG. 1 is a perspective view, partially exploded, of a simplified arrangement by which two very basic SPDT switches can be made to give momentary-off or momentary-on service.

Referring specifically to FIG. 1, the construction that permits only two slide switches to provide nine distinct signals or combinations of signals will now be described. A base 50 has two widely spaced apertures in which are firmly mounted two slide switches $S_1$, $S_2$. Such switches may be equivalent to Model GR 123 SPDT switches manufactured by CW Industries of Warminster, Penn. Slide switch $S_1$ is mounted at one end of the base 50 with an orientation such that it is adapted to provide movement instructions for the driver. By use of the word "movement", it is intended to convey the idea of merely placing the vehicle in motion, without regard to the direction it will move with respect to the ground. An arm 52 extends upward from the housing of switch $S_1$, and it is this arm that must be physically moved in order to make contact with either of the two spaced terminals of the SPDT switch.

Another aperture or recess 54 is provided in the base 50, for the purpose of accommodating approximately one-half of a coil spring 56. The other half of the coil spring 56 is accommodated in a recess or aperture 74 in the plate 70. When the plate 70 is juxtaposed over the base 50 in its normal relationship, the arm 52 will extend into recess 72. Movement of plate 70 along an axis represented by arrow 76 will cause the arm 52 to be similarly moved, and the switch $S_1$ will be actuated.

Figure 2:
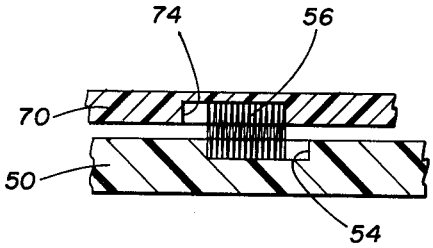
FIG. 2 is a fragmentary view in elevation of the coil spring shown in FIG. 1 as it tends to return the two planar pieces to a centered position.

Upon movement of plate 70 toward the front of the base 50 (as a result of some force being applied thereto), coil spring 56 will be compressed, as shown in FIG. 2. When the external force which caused plate 70 to slide forward has been removed, spring 56 will cause the two pieces 50, 70 to return to their original position.

At the other end of base 50 is a second SPDT slide switch $S_2$, which is rigidly mounted in a way to provide for its arm 58 a movement direction which is perpendicular to the first slide switch $S_1$. A recess or aperture 60 is provided in base 50 near switch $S_2$ to accommodate one-side of coil spring 62. The spring 62 is provided in order to produce a restoring or centering force when plate 70 is physically moved in a direction represented by arrow 78, which is perpendicular to arrow 76. This restoring force is accomplished by providing a companion recess or aperture 80 in plate 70, in line with and above recess 60, and into which spring 62 fits. If the observer exerts a force on post 16 (which is converted into a force on plate 70 in a direction parallel to arrow 78), the plate 70 will pivot about one of the two upright posts 51A, 51B, and spring 62 will be compressed in a manner similar to that shown with regard to spring 56 in FIG. 2. It will be noted that the recess 82 is narrow in the direction in which its associated arm 58 is activated, but wide in an orthogonal direction—so that a force which is applied for the purpose of activating switch $S_1$ will not be resisted by any interference with Switch $S_2$. Similarly, slot 72 has extra clearance on its sides so that plate 70 may be pivoted about a fixed post 51A or 51B without interfering with switch $S_1$. The amount of end clearance shown in slots 72, 82 is exaggerated for clarity, and it is not likely that the throw of a SPDT switch would dictate such a large amount of clearance.

Figure 5A:
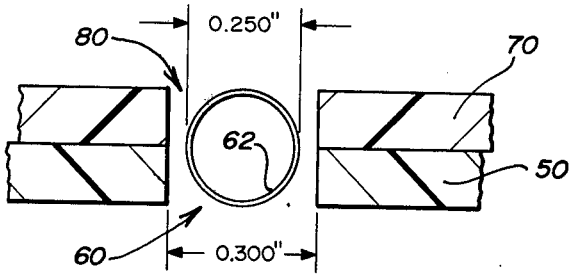
FIGS. 5A, 5B and 5C are fragmentary cross-sectional views of the relative positions of a centering spring and the adjacent structural parts, with the structural parts being shown in three different positions.
Figure 5B:
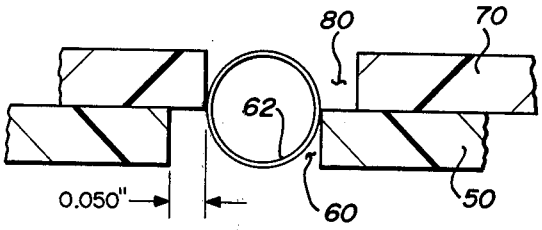
Figure 5C:
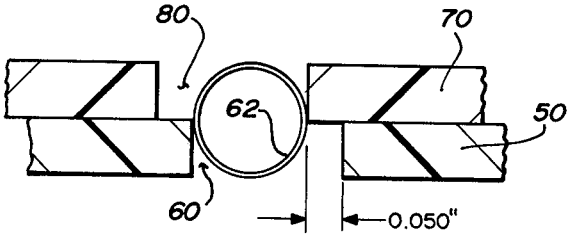

With regard to the amount of side clearance that may be required between the springs 62, 56 and their associated slots 60, 80 and 54, 74, very little such side clearance is required. This will perhaps be readily apparent from an examination of FIGS. 5 and 6. Referring initially to FIG. 5A, which is a transverse view of slots 60, 80, let it be assumed that the spring 62 is ¼ inch in diameter. And, let it be further assumed that the switch $S_1$ has a post 52 which requires movement of 0.050 inch in either direction from its centered position in order for the switch to be actuated. Based upon these assumptions, the width of the slots 60, 80 could be established as a mere 0.300 inch, i.e., the diameter of the spring 62 which is to be accommodated in the slot, plus the excursion distance that the post 52 moves away from its centered position. If the plate 70 is moved 0.050 inch to the right with respect to plate 50, as shown in FIG. 5B, the spring 62 will roll or slide away from its centered position in the slots 60, 80 so that the clearance of 0.050 inch is entirely present on one side of the spring. The switch $S_1$ will have been actuated by this 0.050 inch movement of plate 70, but the spring 62 (which is entirely passive during actuation of switch $S_1$) will not have been distorted or pinched by movement of plate 70 to the right. In a similar manner, movement of post 52 (and plate 70) to the left with respect to switch $S_1$, as illustrated in FIG. 5C, is made possible by virtue of the fact that the spring 62 will also roll or slide to the left, so that the 0.050 inch clearance between the spring 62 and slot 60 is now present on the right side; and, the 0.050 inch clearance between the spring 62 and slot 80 is present on the left side. Expressed another way, the side clearance for a given slot need be no more than ½ of the total excursion length for the switching element of a SPDT switch—in order to insure adequate clearance for a spring when the movable plate is being pushed in a direction wherein the spring is not being axially compressed.

Figure 4:
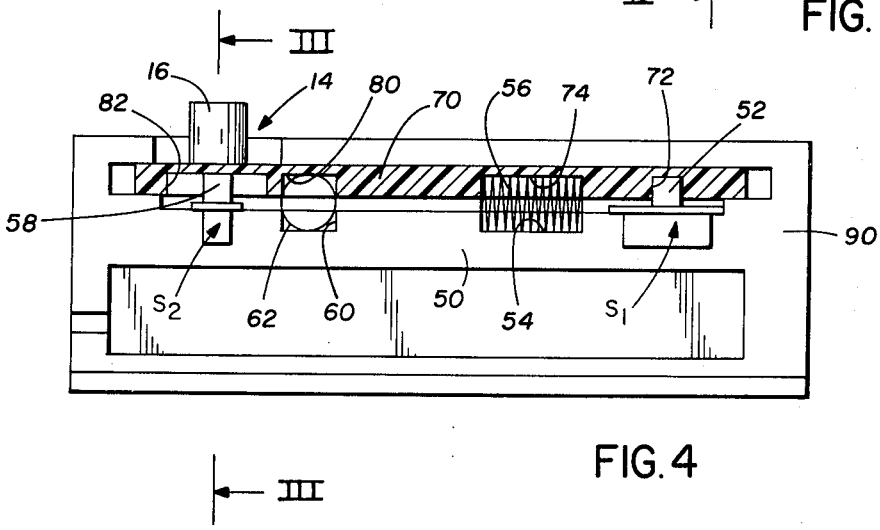
FIG. 4 is a cross-sectional elevation view of a switch box, taken in the plane indicated by lines IV—IV in FIG. 3.

Of course, the schematic showings of the springs 56, 62 in FIGS. 1 and 4 do not readily lend themselves to the showing of clearances on the order of 0.050 inch. And, obviously, the representations of the slots and springs in FIGS. 5A, 5B, and 5C are greatly exaggerated, for the purpose of clarity.

With regard to the amount of side clearance required in slots 54, 74 in order to preclude interference with pivotal movement of plate 70 in a direction of arrow 78, an even smaller amount of clearance than the 0.050 inch provided in the other slots would be tolerable. Indeed, the very small clearance (on the order of 0.005 inch) which is needed is actually below the manufacturing tolerance that a manufacturer might expect to have in mass-produced parts. This is made possible by locating the slots 54, 74 in a position such that they lie on a line extending between the two pivot posts 51A, 51B. With such an arrangement, the actual movement of a corner of slot 74 as the distant switch $S_2$is actuated will be relatively small. This will perhaps be better appreciated by an evaluation of FIGS. 6 and 7.

Figure 6:
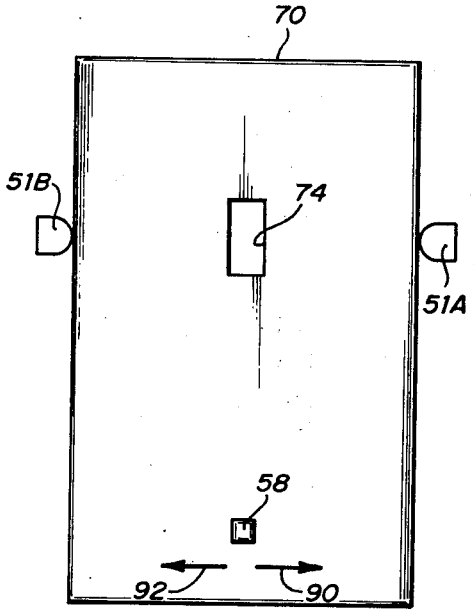
FIG. 6 is a partial top view of an upper plate, showing only those features necessary to explain the size requirements for a particular one of the slots in which a centering spring is placed.

Referring next to FIG. 6, it includes only those portions of the plate 70 and post 58 of switch $S_2$ which are necessary for an understanding of the side clearance in slot 74. As the end of plate 70 is moved either to the right (in the direction of arrow 90) or to the left (in the direction of arrow 92), the corners of slot 74 will move by a much smaller amount, because of their proximity to the pivot axis. For example, let it be assumed that the throw of switch $S_2$ in the direction of arrow 90 is the same 0.050 inch referred to above, and that the longitudinal distance from the pivot axis (between post 51A, 51B) to post 58 is 2½ inches. Let it further be assumed that slot 74 is ½ inch long, and said slot is bisected by the pivot axis. Hence, the corners of the slot 74 will lie respectively 0.25 inch above and below the pivot axis.

Figure 7:
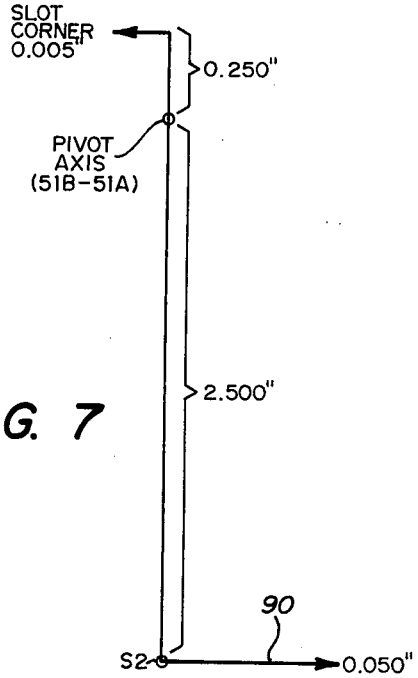
FIG. 7 is a diagrammatic view of the amount of relative movement of certain parts of the plate shown in FIG. 6, as said plate is rotated during actuation of switch $S_2$.

Referring next to FIG. 7, let it be assumed that plate 70 (and post 58) has been manually pushed in the direction of arrow 90 for the required 0.050 inch in order to actuate switch $S_2$. Because of the 10:1 ratio between the 2½ inch arm from the pivot to post 58, with respect to the 0.25 inch arm from the pivot to a distal corner of slot 74, the translation of that distal corner is only 1/10 of the 0.050 inch movement of post 58, i.e., 0.005 inch. Of course, if for some reason the switch $S_2$ should be installed closer to slot 74, the reduced side clearance in slot 74 made possible by virtue of the long pivot arm would be correspondingly reduced. But the amount of side clearance needed in any given slot will never exceed the amount of the throw of that slide switch whose freedom to move is being insured.

Figure 3:
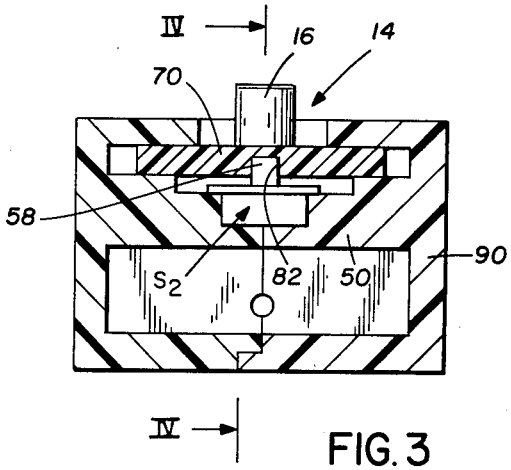
FIG. 3 is a cross-sectional elevation view of a switch box, taken in the plane indicated by lines III—III in FIG. 4.

While FIG. 1 adequately shows how the principal parts of a control device are arranged, a commercial embodiment of the control box 14 will probably look more like that shown in FIGS. 3 and 4. A housing 90 (which is typically plastic) has an integrally molded ledge which provides a fixed base which is equivalent to the aforementioned base 50, and slide switches $S_1$ and $S_2$ can be seen mounted thereon. Rigidly attached to plate 70 is knob 16, so that the observer who holds the device in his hand can move the plate by exerting a force with a finger against the knob. Movement of the plate 70 in a direction parallel to its longitudinal axis, i.e., a direction parallel to arrow 76, will activate slide switch $S_1$; and movement along an orthogonal axis will activate slide switch $S_2$.

With particular reference to FIG. 4, it will be understood that coil spring 56 is mounted in a direction which is parallel to slide switch $S_1$. Coil spring 62 is mounted in a perpendicular direction, such that it is parallel to its associated slide switch $S_2$. The opposite sides of both coil springs extend partially into both the base 50 and the movable plate 70. One benefit obtained from this construction is that relative movement between the base 50 and the plate 70 in any direction parallel to the plate is axially resisted by either spring 56 or spring 62 or both. If desired, the springs may be pre-loaded (in compression) so that there is no free travel of the plate 70 before a restoring force is imposed on the plate. When the springs are pre-loaded, i.e., compressed during assembly of the box 90, there will be no slack in the system and the arms 52, 58 will always be initially centered along their excursion paths in the switches. Suitable electrical conductors (not shown in this figure) naturally connect the slide switches to respective loads or display elements. The cavity shown in FIGS. 3 and 4 below the plate 50 provides ample room for a plurality of wires as well as a battery (if needed), etc.

While the apparatus 14 shown in FIGS. 3 and 4 is a preferred embodiment for generating signals to meet the needs of a vehicle driver, it should be apparent to those skilled in the art that the same basic switching system could be adapted for use in generating signals for other functions. For example, a switch made in accordance with the disclosed invention could be employed to move a vehicle seat with regard to the frame of said vehicle, i.e., forward or backward, up or down, etc., for the comfort of the driver. Another way in which a similar switch might be employed is to control the action of an electric crane which has a boom that moves up and down or in and out, as well as a motor-driven reel that either releases or accumulates cable on which a hook is suspended. Still another example of a possible use of the switch includes controlling a mechanical arm or the like where there is both a requirement to position the arm correctly and then cause it to perform some task—such as gripping an object at one location and releasing it at another. Another possible use includes controlling an electrically powered wheel chair, where there is the need to make the chair roll forward or backward, as well as make it turn right or left; and just as with the guidance device 14 shown in FIG. 4, there will sometimes be the need to turn a wheel chair at the same time that movement is desired. All of these tasks involve multiple functions that are capable of being controlled by the relatively simple switch assembly disclosed herein.

It is also worthy of mention that the switch assembly disclosed herein is particularly easy to manufacture, because the centering springs are floating and do not have to be physically connected to any moving or fixed part. The springs 56, 62 may be installed by the simple act of dropping them into place into their respective slots 54, 60 and then placing the plate 70 over them; no jig, fixture or skilled labor is involved, because the springs are inherently self-centering (in a side-ways direction) in their slots. Too, no special skill is required in positioning the SPDT slide switches in their respective recesses; and the entire assembly can be put together with little effort. Furthermore, unlike some other switches which are rendered inoperative because of the mechanical failure of a spring (as when a hook breaks off the end of a tension spring), the switch disclosed herein is particularly free from any characteristics that would render it susceptible to fatigue failure, etc.

Additionally, the physical size of the embodiment shown in FIGS. 3 and 4 should be understood to be exemplary and not limiting. Thus, the physical size of the assembly may be reduced, if desired, to a size not appreciably larger than the area encompassed by two perpendicular SPDT switches. In this regard, it will perphaps be profitable to define a longitudinal axis of the switch assembly, which axis extends between two slide switches. In the example of FIG. 1, the longitudinal axis of assembly 14 would be parallel to arrow 76, i.e., it would extend through switch $S_1$ and would intersect switch $S_2$. While it has been found advantageous to make this longitudinal axis significantly longer than the excursion paths of the respective arms 52, 58, it should be understood that the longitudinal axis of a given embodiment can be shortened if desired to fit a particular spatial envelope. Also, it should be apparent that whether the switch assembly is categorized as a momentary-on or a momentary-off switch is a matter of choice. Thus, if the centered position of the SPDT slide switch is wired so as to be "off", then the spring-biased assembly would have momentary-on characteristics. But, if the center position is wired so as to be electrically "on", then moving to one or the other of the two side positions would provide distinctive signals to certain loads.

Figure 8:
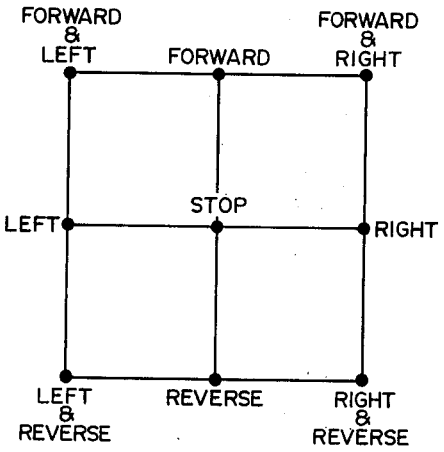
FIG. 8 is a sketch of the nine positions into which a control member can be placed—in order to realize nine distinct signals from a special assembly of two SPDT slide switches.

FIG. 8 illustrates the nine basic signals which can be generated by the switch assembly shown in FIG. 1, including move forward, move forward and to the left, move forward and to the right, move backward, stop, turn left, etc.

While only a preferred embodiment of the invention has been disclosed in great detail herein, it should be apparent to those skilled in the art that modifications thereof can be made without departing from the spirit of the invention. For example, a single-pole, double-throw toggle switch could be readily substituted for either of the slide switches described herein, without affecting the general operation of a switching assembly. As long as the individual switches are characterized as SPDT switches, the movable plate 70 can be moved from its centered rest position in the plus and minus "*y*" directions and the plus and minus "*x*" directions—as well as combinations thereof, to provide a total of eight distinct signal-generating positions radially distributed around the centered rest position. For a more thorough treatment of the use of the preferred embodiment shown in FIGS. 3 and 4, reference is made to the disclosure in U.S. Pat. No. 3,944,972 entitled "Communication Device for Assisting the Driver of a Vehicle".

What is claimed is:

1. Switching apparatus comprising:

(a) a fixed base;

(b) a first slide switch characterized as a single-pole, double-throw switch which is mounted at one end of said base, and a second single-pole, double-throw slide switch mounted at the other end of the base, and the second switch being mounted in a direction which is perpendicular to the first switch, and both of said slide switches having projecting arms by which the switches are activated;

(c) a movable plate juxtaposed over said base, said plate having two spaced recesses into which the projecting arms of the two slide switches are fitted, and said recesses being sized such that movement of the plate along one axis will activate one of the slide switches and movement along an orthogonal axis will activate the other slide switch; and (d) structural means against which a manual force may be applied to the movable plate, so as to slide the plate with respect to the base and thereby move at least one of the projecting arms, whereby at least one of the two slide switches will be activated.

2. The switching apparatus as claimed in claim 1 and further including spring means for biasing the movable plate to a rest position at which the activating arms are centered along their respective excursion paths.

3. The apparatus as claimed in claim 2 wherein said spring means constitutes a first coil spring mounted in a direction which is parallel to the first slide switch, and a second coil spring mounted in a direction parallel to the second slide switch, with opposite sides of said coil springs extending partially into both the base and the movable plate, whereby relative movement between the base and the plate in a direction parallel to the plate is resisted by at least one of said springs.

4. The apparatus as claimed in claim 1 and further including physical restraint means for serving as a pair of pivot points located relatively near one end of the movable plate, with one of the pair of pivot points being located on one side of the plate and the second pivot point being on the opposite side of the plate, and the base having a longitudinal axis defined by a line that extends between the two slide switches, and that slide switch which is nearer the pivot points being oriented longitudinally with respect to the movable plate, whereby longitudinal movement of the plate between the two pivot points activates the slide switch nearer the pivot points, and whereby pivotal movement of the plate with respect to a pivot point activates the slide switch which is more remote from the pivot points.

5. The apparatus as claimed in claim 1 wherein the means for selectively applying a force to the movable plate consitutes a single knob extending above the apparatus where it may be manually moved in either of at least two orthogonal directions from a centered position to another position.

6. The switching apparatus as claimed in claim 1 and further including at least one coil spring which is arranged with its longitudinal axis parallel to the plane in which the movable plate is adapted to move, and said spring being mounted in a floating mode such that it resists plate movement which is parallel to its longitudinal axis but does not resist plate movement in a direction perpendicular to its longitudinal axis.

7. An electrical switch assembly, comprising:

(a) a housing having a base and a plate movable with respect to the base in at least four orthogonal directions away from a centered rest position; and (b) a set of two single-pole, double-throw switches mounted in the housing so that the posts of both switches are in their centered positions when the movable plate is in its centered position, and the two switches being oriented substantially perpendicular to each other, and the posts of both switches being connected to the movable plate in such a way that movement of said plate in a singular one of the four directions away from the center position will cause translation of the post of one of the slide switches without moving the other post, thereby actuating the switch whose post has been moved without affecting the other switch.

8. The electrical switch assembly as claimed in claim 7 and further including spring means for biasing the movable plate to its centered rest position at all times.

9. The electrical switch assembly as claimed in claim 8 wherein the spring means constitutes a pair of perpendicularly arranged compression springs which abut respective ends of juxtaposed cavities in the base and the movable plate.

10. A switch assembly, comprising:

(a) a base;

(b) a movable plate juxtaposed with the base for movement in a plane parallel to and very near the base;

(c) a pair of single-pole, double-throw switches mounted on the base with their posts protruding upward toward the movable plate, with said pair of switches being oriented approximately perpendicular to each other;

(d) said movable plate having a first slot positioned to receive the post of the first switch, with the slot being relatively narrow in a direction parallel to the excursion path of its associated switch and relatively wide in a direction perpendicular to said excursion path; and (e) said movable plate having a second slot positioned to receive the post of the second switch, with the slot being relatively narrow in a direction parallel to the excursion path of its associated switch and relatively wide in a direction perpendicular to said excursion path, whereby movement of the plate in a given direction may cause movement of the post of one of said switches but not the other switch.

11. The switch assembly as claimed in claim 10 and further including a first coil spring and a pair of juxtaposed and cooperating recesses for holding said coil spring, with one of said recesses being in the base and the other being in the movable plate, and the orientation of said first pair of recesses being parallel to the excursion path of the post of the first switch, whereby plate movement which is parallel to the first switch in either direction causes said first coil spring to be compressed.

12. The switch assembly as claimed in claim 11 and further including a second coil spring and a pair of juxtaposed and cooperating recesses for holding said second coil spring, with one of said recesses being in the base and the other being in the movable plate, and the orientation of said second pair of recesses being parallel to the excursion path of the post of the second switch, whereby plate movement which is parallel to the second switch in either direction causes said second spring to be compressed.

13. The switch assembly as claimed in claim 10 and further including a structural element rigidly connected to said movable plate and exposed where it may be manually contacted and moved with respect to the base, causing activation of a selected one of said individual switches through movement of said plate.

14. The switch assembly as claimed in claim 13 wherein said manually movable structural element is movable from a centered rest position in the plus and minus "*y*" directions and the plus and minus "*x*" directions, as well as combinations thereof, such that said element is movable to at least eight distinct signal-generating positions radially distributed around the centered rest position.

* * * * *